US005427282A

United States Patent [19]

Greenleaf et al.

[11] Patent Number: 5,427,282

[45] Date of Patent: Jun. 27, 1995

[54] AEROSOL VALVE WITH A SURFACTANT IMPREGNATED VALVE SEAL

[75] Inventors: David J. Greenleaf, Loughborough; Peter H. Howarth, Beeston; Philip A. Jinks, Mountsorrel, all of England

[73] Assignee: Minnesota Mining and Manufacturing Company, St. Paul, Minn.

[21] Appl. No.: 256,067

[22] Filed: Jun. 17, 1994

[51] Int. Cl.[6] ..... B65D 83/00

[52] U.S. Cl. ..... 222/402.1; 277/228; 277/DIG. 6; 427/384

[58] Field of Search ..... 222/402.1; 277/228, 277/227, DIG. 6; 427/384

[56] References Cited

U.S. PATENT DOCUMENTS 3,560,607 2/1971 Hartley ..... 424/46
4,023,710 5/1977 Alexander et al. ..... 222/148
4,741,965 5/1988 Zerfass et al. ..... 277/DIG. 6
4,944,433 7/1990 Knecht et al. ..... 222/402.1 X

FOREIGN PATENT DOCUMENTS 654599 4/1965 Belgium .
0147028A1 7/1985 European Pat. Off. .... A61M 15/00
2528060 6/1983 France ..... C09K 3/10

*Primary Examiner*—Gregory L. Huson
*Attorney, Agent, or Firm*—Gary L. Griswold; Walter N. Kirn; Dale E. Hulse

[57] ABSTRACT

An aerosol valve having a valve ferrule, a valve stem, and at least one valve seal, in which the valve seal is impregnated with a physiologically acceptable surfactant. The valves of the invention exhibit improved force-to-fire and improved return force compared to valves containing untreated valve seals.

18 Claims, 1 Drawing Sheet

AEROSOL VALVE WITH A SURFACTANT IMPREGNATED VALVE SEAL

Figure 1:
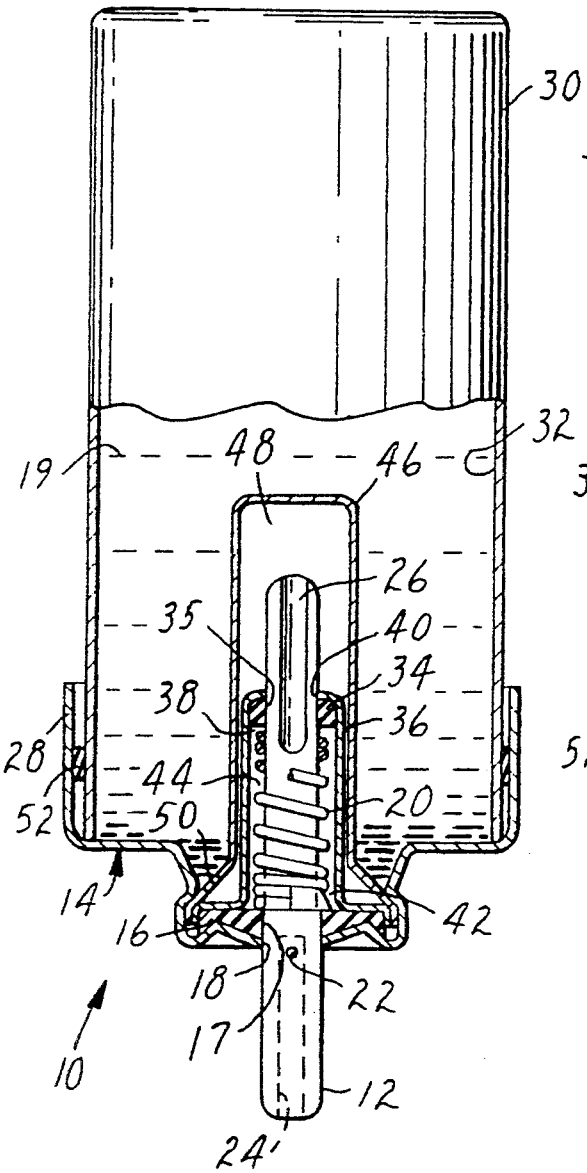

This invention relates to aerosol valves and to valve seals for use therein. The invention also relates to a method of providing sustained lubrication to aerosol valves, particularly valves used for dispensing medicament to the respiratory system of a patient.

The use of aerosol devices to administer drugs or other therapeutically active compounds by inhalation therapy is common. Aerosol dispensing containers are charged with a self propelling liquid composition containing the medicament dissolved or dispersed therein and provided with an aerosol valve capable of discharging metered amounts of the composition. Such aerosol dispensing containers may be incorporated into a device including a breath actuated mechanism to synchronize dispensing of the medicament with inspiration by the patient. An example of such a device is the AUTOHALER TM brand aerosol inhalation device (3M) disclosed, for example, in European Patent No. 147028.

Lubrication is an important factor in aerosol valves for use in inhalers. Lack of lubrication within a valve can cause sticking and high friction between the valve seals and the valve stem. This requires high firing forces in order to actuate the valve which can cause difficulty for the patient to coordinate valve actuation and inhalation simultaneously. Lack of lubrication within an aerosol valve may also result in slow return or non-return of the valve stem after actuation. Breath actuated devices require a smoothly functioning valve in order to ensure the proper function of the device.

The term "valve seal" used herein is used generically to refer to any of the seals employed within an aerosol valve and includes, but is not limited to, the diaphragm, tank seal and sealing member (parts 16, 34, and 52 of the valve shown in the accompanying drawing).

Valve seals used in aerosol valves for inhalers are generally subjected to a prolonged wash in a solvent, e.g., an aerosol propellent, such as Propellent 11 under reflux, in order to extract process oils and other additives which are present in the elastomer mix from which the valve rubbers are made. The purpose of the extraction process is to remove any components from the valve seals which might be leached out by contact with the aerosol formulation in the container to which the valve is applied. The presence of such extracts in the aerosol formulation may produce an unacceptable taste, may cause instability of the aerosol formulation or in an extreme case may be deleterious to the health of the patient.

After the extraction process the valve seals are lubricated by a light wash in a solution of lubricant, such as silicone, or surfactant, such as sorbitan trioleate. Such treatment has proved to be satisfactory in many cases, particularly when the valves are used with aerosol formulations containing surfactants in a sufficient amount to provide supplementary lubrication to the valve rubbers during the life of the aerosol product. However, it has been found that such lubrication treatment is not effective for the lifetime of the aerosol product in cases where the aerosol formulations contain low levels of surfactant or are surfactant free. The problem is particularly exacerbated when the propellent of the aerosol composition is a solvent for the lubricant or surfactant which has been applied to the valve rubber.

Attempts to overcome this problem by washing with concentrated solutions of lubricant or surfactant have not been successful since there appears to be no significant increase in lubrication above a certain concentration and higher concentrations tend to result in valve seals having sticky surfaces which can cause problems in assembly machinery used in the fabrication of the valves.

It has now been found that improved lubrication properties may be imparted to valve seals by impregnating the seals with a suitable surfactant.

Therefore according to the present invention there is provided an aerosol valve comprising a valve ferrule, a valve stem and at least one valve seal in which the valve seal is impregnated with a physiologically acceptable surfactant.

Also according to the invention there is provided a device comprising an aerosol container containing a self propelling aerosol formulation comprising aerosol propellent and a medicament, the container being equipped with an aerosol valve.

It has surprisingly been found that by soaking valve seals for prolonged periods, e.g., at least 2 hours, preferably at least 4 hours, more preferably about 8 hours in a solution of surfactant the surfactant becomes absorbed or impregnates the rubber material. While not wishing to be bound by theory, it is believed the surfactant is impregnated into interstices within the rubber which are formed when processing additives are extracted from the rubber and by the rubber swelling when immersed in the solvent.

Suitable surfactants include those previously employed in aerosol valves or aerosol formulations for inhalation therapy. Anionic, cationic, and amphoteric surfactants are suitable. Suitable anionic surfactants include saturated and unsaturated fatty acids, preferably those containing from 10 to about 22 carbon atoms (such as oleic acid). Suitable nonionic surfactants include anhydrosorbitol esters such as sorbitan trioleate. Suitable amphoteric surfactants include phosphatidyl cholines such as lecithin. Preferred surfactants include oleic acid and lecithin. Most preferred is sorbitan trioleate.

The solvent may be selected from those which are known to be non-toxic, a preferred solvent being Propellent 11.

It has been found that the aerosol valves of the invention have improved lubrication compared with untreated valves. Accordingly the aerosol valves of the invention find particular utility when used in connection with an aerosol formulation that contains less than an effective lubricating amount of surfactant. The improved lubrication properties often result in a significant reduction in the firing force compared with an untreated valve seal. Likewise a significant increase in return force is often seen, which ensures the valve stem returns to the closed position without sticking. Compared to valves of the invention, valves having valve seals which are only lightly washed with a solution of surfactant lose the improved properties relatively soon after the valve is put to use.

The valve seals, or rubber from which they are made, are preferably subjected to an extraction process prior to treatment to impart improved lubrication. The extraction preferably comprises a continuous wash with Propellent 11 for at least 24, normally 48 or 72 hours, the Propellent 11 being provided in a constant stream after distillation and allowed to flow back into the reservoir.

The treatment with solution of surfactant may be conducted on the rubber material from which the valve seals are made, or the valve seals, optionally after the seals have been assembled on the valve stem. The valve seals may be fabricated from any of the rubber materials used as seals for aerosol valves, e.g., nitrile and neoprene rubbers.

The aerosol valves of the invention are particularly useful with aerosol formulations having low levels, e.g., levels of 0.3% by weight and below of surfactant and exhibit good lubricant properties with surfactant levels of 0.1% by weight and below and with formulations which contain no surfactant. It is preferred that formulations having no, or very low levels of surfactant, are based on propellents in which the surfactant impregnating the valve seal is substantially insoluble in order to prevent leaching out of the surfactant from the valve seal on prolonged contact with the formulation. Preferred propellents are selected from Propellent 11, Propellent 12, Propellent 114, Propellent 134*a*, and Propellent 227.

The aerosol valves of the invention are preferably incorporated into devices for delivery of medicament to the respiratory system of a patient. Generally, although not exclusively, the medicament will be selected for treatment of the respiratory system, e.g., for asthma therapy. Suitable medicaments include salbutamol, terbutaline, rimiterol, fenoterol, pirbuterol, adrenaline, isoprenaline, ipratropium bromide, theophylline, beclomethasone, betamethasone, budesonide, formoterol, cromoglycic acid and salts and esters thereof.

Aerosol valves for use in this invention comprise a valve stem, a diaphragm having walls defining a diaphragm aperture, and a casing member having walls defining a casing aperture, wherein the valve stem passes through the diaphragm aperture and the casing aperture and is in slidable sealing engagement with the diaphragm aperture, and wherein the diaphragm is in sealing,engagement with the casing member.

Metered dose aerosol devices for use in this invention comprise, in addition to the above discussed valve stem, diaphragm, and casing member, a tank seal having walls defining a tank seal aperture, and a metering tank of a predetermined volume and having an inlet end, an inlet aperture, and an outlet end, wherein,the outlet end is in sealing engagement with the diaphragm, the valve stem passes through the inlet aperture and the tank seal aperture and is in slidable engagement with the tank seal aperture, and the tank seal is in sealing engagement with the inlet end of the metering tank, and wherein the valve stem is movable between an extended closed position, in which the inlet end of the metering tank is open and the outlet end is closed, and a compressed open position in which the inlet end of the metering tank is substantially sealed and the outlet end is open to the ambient atmosphere.

Figure 2:
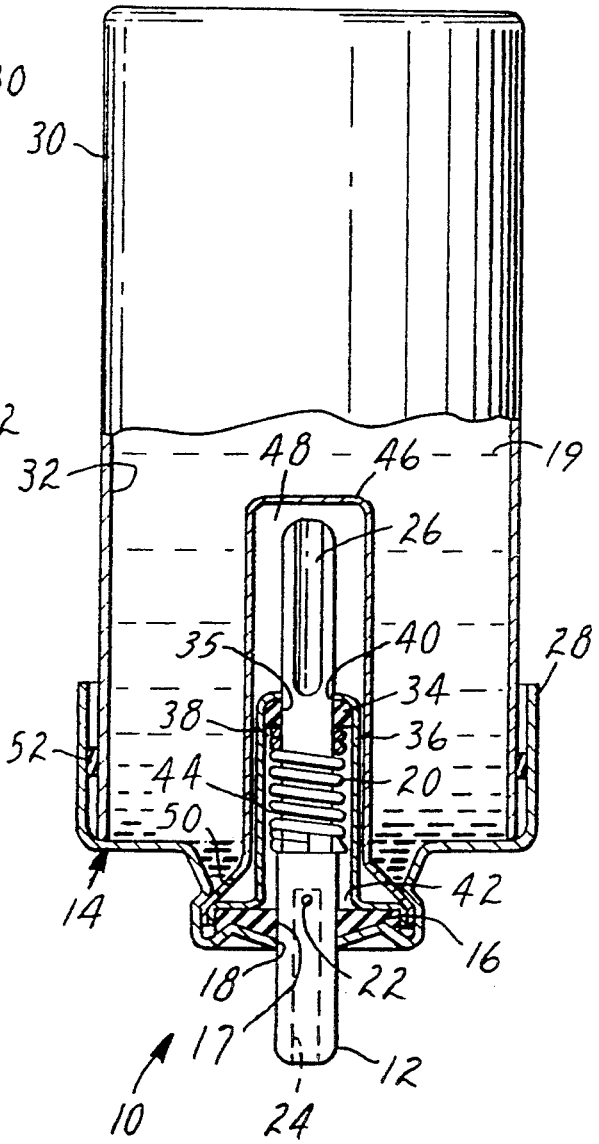

FIGS. 1 and 2 of the accompanying drawing illustrate the construction of an aerosol valve.

FIG. 1 is a partial cross-sectional view of one embodiment of a valve wherein the valve stem is in the extended closed position, FIG. 2 is a partial cross-section view of the embodiment illustrated in FIG. 1 wherein the valve stem is in the compressed open position.

FIG. 1 shows device (10) comprising valve stem (12), casing member (14), and diaphragm (16). The casing member has walls defining casing aperture (18), and the diaphragm has walls defining diaphragm aperture (17). The valve stem passes through and is in slidable sealing engagement with the diaphragm aperture. The diaphragm is also in sealing engagement with casing member (14).

Valve stem (12) is in slidable engagement with aperture (18). Helical spring (20) holds the valve stem in an extended closed position as illustrated in FIG. 1. Valve stem (12) has walls defining orifice (22) which communicates with exit chamber (24) in the valve stem. The valve stem also has walls defining channel (26).

In the illustrated embodiment casing member (14) comprises mounting cup (28) and canister body (30) and defines,formulation chamber (32). The illustrated embodiment further comprises tank seal (34) having walls defining tank seal aperture (35), and metering tank (36) having inlet end (38), inlet aperture (40), and outlet end (42). The metering tank also has walls defining metering chamber (44) of predetermined volume, e.g., 50 μl. Outlet end (42) of metering tank (36) is in sealing engagement with diaphragm (16), and valve stem (12) passes through inlet aperture (40) and is in slidable engagement with tank seal (34).

When device (10) is intended for use with a suspension aerosol formulation it further comprises retaining cup (46) fixed to mounting cup (28) and having walls defining retention chamber (48) and aperture (50). When intended for use with a solution aerosol formulation retaining cup (46) is optional. Also illustrated in device (10) is sealing member (52) in the form of an O-ring that substantially seals formulation chamber (32) defined by mounting cup (28) and canister body (30).

Operation of device (10) is illustrated in FIGS. 1 and 2. In FIG. 1, the device is in the extended closed position. Aperture (50) allows open communication between retention chamber (48) and formulation chamber (32), thus allowing the aerosol formulation to enter the retention chamber. Channel (26) allows open communication between the retention chamber and metering chamber (44) thus allowing a predetermined amount of aerosol formulation to enter the metering chamber through inlet aperture (40). Diaphragm (16) seals outlet end (42) of the metering tank.

FIG. 2 shows device (10) in the compressed open position. As valve stem (12) is depressed channel (26) is moved relative to tank seal (34) such that inlet aperture (40) and tank seal aperture (35) are substantially sealed, thus isolating a metered dose of formulation within metering chamber (44). Further depression of the valve stem causes orifice (22) to pass through aperture (18) and into the metering chamber, whereupon the metered dose is exposed to ambient pressure. Rapid vaporization of the propellent causes the metered dose to be forced through the orifice, and into and through exit chamber (24). Device (10) is commonly used in combination with an actuator that facilitates inhalation of the resulting aerosol by a patient.

A particularly preferred device for use in the invention is a metered dose configuration substantially as described above and illustrated in the drawing. Other particular configurations, metered dose or otherwise, are well known to those skilled in the art are suitable for use with the sealing members of this invention. For example the devices described in U.S. Pat. Nos. 4,819,834 (Thiel), 4,407,481 (Bolton), 3,052,382 (Gawthrop), 3,049,269 (Gawthrop), 2,980,301 (DeGorter), 2,968,427 (Meshberg), 2,892,576 (Ward), 2,886,217

(Thiel), and 2,721,010 (Meshberg) involve a valve stem, a diaphragm and a casing member in the general relationship described herein.

The invention will now be illustrated by the following Examples.

In the following Examples the rubber components (diaphragm and metering tank seal) were treated to extract processing additives by continuous washing in Propellent 11 for 48 hours at room temperature.

EXAMPLE 1

This Example used a 50 μL metered dose dispensing valve commercially available from 3M Health Care under the product code A14874. The valve comprises a diaphragm (top seal) of nitrile rubber commercially available from Avon and a metering tank seal of nitrile rubber commercially available from Kirkhill.

Two batches of valves were built using identical manufacturer's batch number components. The valve stems were washed for 5 minutes in 1% by weight dimethicone solution in Propellent 11 and allowed to dry. The valve seals of one batch were soaked in a 2% by weight solution of sorbitan trioleate in Propellent 11 for 8 hours.

The valves were applied to aerosol containers which were filled with a medicinal formulation commercially available under the trade mark Zeisin, comprising pirbuterol acetate, 0.3% w/w sorbitan trioleate and a propellent system 70 parts Propellent 12 and 30 parts Propellent 11. The force-to-fire and return force for each valve were measured:

| | Untreated Valve seals | Treated Valve seals |
|---|---|---|
| Force to fire (N) | 27.4 | 22.4 |
| Return force (N) | 6.6 | 8.0 |

This reduction in firing force was achieved through minimizing valve friction; the springs being identical in both batches.

This reduction in firing force was significant enough to allow the valve to be used in the AUTOHALER TM brand aerosol inhalation device.

Tests on the same valves showed that the initial low firing forces remained constant throughout the life of the unit.

EXAMPLE 2

This Example used a 50 μL metered dose dispensing valve commercially available from 3M Health Care under the product code A66122. The valve comprises diaphragm and tank seals of nitrile rubber commercially available from Dowty.

Two batches of valves (9 in each batch) were assembled as in Example 1, the valve stems were not treated and the valve seals of one batch were treated as in Example 1.

The valves were applied to aerosol containers which were filled with a medicinal formulation consisting of drug (0.24 mg/ml) and Propellent 134*a*. The valves were tested immediately after preparation of the units and after 1 week:

| | Untreated Valve seals | | Treated Valve seals | |
|---|---|---|---|---|
| | Force to Fire (N) | Return Force (N) | Force to Fire (N) | Return Force (N) |
| Initial | 27.8 | 2.1 | 22.5 | 5.7 |
| 1 week | 26.6 | did not return | 22.3 | 4.6 |

It is noted that, in this case, a significant reduction in firing force and a large increase in return force was seen in the valves of the invention.

EXAMPLE 3

The valves used were the same type as in Example 1. Two batches of valves were prepared in a similar manner to Example 1. One batch of valve seals (comparative) were washed in 1% by weight dimethicone solution in Propellant 11 for 2 minutes and allowed to dry, the other batch (treated in accordance with the invention) was soaked in sorbitan trioleate as in Example 1.

The valves were applied to aerosol containers which were filled with a medicinal formulation comprising beclomethasone dipropionate (100 μg/dose), 0.5 mg/ml sorbitan trioleate and a propellent system consisting of 5% Propellent 11 and 95% of a 15:85 mixture of Propellent 114 and Propellent 12.

| | Comparative Valve seals | Treated Valve seals |
|---|---|---|
| Force to fire (N) | 29.9 | 26.3 |
| Return force (N) | 6.4 | 6.8 |

Treatment is seen to decrease the force-to-fire and increase the return force, both desirable attributes resulting from lower friction. In addition, the tendency for decreasing the return force during the life of the inhaler was less for the treated valve seals.

EXAMPLE 4

Valves of the type used in Example 1 were used. The valve stems were washed and dried according to the general method of Example 1. The valve seals were treated by soaking for 24 hours in a P11 solution containing 2 percent by weight of a surfactant listed in the table below.

The valves were crimped on to aerosol canisters containing HFC-134*a* or HFC-227 (as indicated) and allowed to stand for three days before testing. In the table below, "Untreated" represents a control group wherein the valve seals were not treated. "P11" represents a control group wherein the valve seals were soaked for 24 hours in P11 alone. The other column headings refer to the respective surfactants used to treat the valve seals. Each group contained 20 vials. "FTF" indicates force to fire the valve. "RF" indicates return force for the valve. Initial results and results after 25 doses are given in Newtons with standard deviation in parentheses.

TABLE 1

| | | Untreated | | P11 | | Soya Lecithin | | Span 85 | | Oleic Acid | |
|---|---|---|---|---|---|---|---|---|---|---|---|
| Propellant | | FTF | RF | FTF | RF | FTF | RF | FTF | RF | FTF | RF |
| 134a | Initial | 28.05 | 6.62 | 33.59 | 543 | 27.95 | 5.13 | 25.82 | 7.83 | 25.87 | 7.72 |
| | | (1.02) | (0.72) | (1.56) | (0.78) | (1.56) | (0.60) | (1.20) | (0.49) | (1.25) | (0.55) |
| | 25 | 27.87 | 6.80 | 33.36 | 5.36 | 28.80 | 5.37 | 24.92 | 8.24 | 25.77 | 7.84 |

TABLE 1-continued

| Propellant | | Untreated | | P11 | | Soya Lecithin | | Span 85 | | Oleic Acid | |
|---|---|---|---|---|---|---|---|---|---|---|---|
| | | FTF | RF | FTF | RF | FTF | RF | FTF | RF | FTF | RF |
| | doses | (1.14) | (0.83) | (1.51) | (0.49) | (0.91) | (0.70) | (1.06) | (0.46) | (0.85) | (0.47) |
| 227 | Initial | 27.95 | 5.32 | 32.68 | 2.69 | 24.58 | 5.73 | 24.22 | 7.22 | 25.19 | 5.87 |
| | | (1.56) | (0.40) | (1.84) | (0.94) | (0.89) | (0.57) | (0.72) | (0.56) | (0.80) | (0.51) |
| | 25 | 28.67 | 4.67 | 32.58 | 1.48 | 24.77 | 5.67 | 23.48 | 7.26 | 25.47 | 5.31 |
| | doses | (1.42) | (0.68) | (2.99) | (0.73) | (1.07) | (0.55) | (0.73) | (0.47) | (0.86) | (0.50) |

The table above shows that valve seals treated according to the invention with Span 85 or oleic acid show decreased force to fire and increased return force when used in connection with HFC-134*a* or HFC-227, compared to the untreated control group. The valve seals treated according to the invention with lecithin showed decreased force to fire and increased return force compared to the untreated control group when used in connection with HFC-227 but not with HFC-134*a*. The P11 group showed increased force to fire and decreased return force compared to control.

What is claimed is:

1. An aerosol valve comprising a valve ferrule, a valve stem and at least one valve seal in which the valve seal is impregnated with a physiologically acceptable surfactant.

2. An aerosol valve as claimed in claim 1 in which the valve seal comprises nitrile or neoprene rubber.

3. An aerosol valve according to claim 1 wherein the surfactant is a $C_{10}$–$C_{22}$ fatty acid, an anhydrosorbitol ester, or a phosphatidyl choline.

4. An aerosol valve as claimed in claim 1 wherein the surfactant is the valve seal is sorbitan trioleate.

5. An aerosol valve according to claim 1 wherein the surfactant is oleic acid or lecithin.

6. A device comprising an aerosol container containing a self propelling aerosol formulation comprising aerosol propellent having dissolved or dispersed therein a medicament, the container being equipped with an aerosol valve as claimed in claim 1.

7. A device as claimed in claim 6 in which the aerosol formulation contains less than an effective lubricating amount for an aerosol valve of a surfactant.

8. A device as claimed in claim 6 in which the aerosol formulation comprises less than 0.1% by weight of surfactant.

9. A device as claimed in claim 6 in which the aerosol formulation is free of surfactant.

10. A device as claimed in claim 6 in which the surfactant impregnating the valve seal is substantially insoluble in the aerosol propellent.

11. A device as claimed in claim 6 in which the propellent is selected from Propellent 11, Propellent 12, Propellent 114, Propellent 134*a*, Propellent 227, and mixtures thereof.

12. A method for imparting lubricating properties to a valve seal for an aerosol valve or to the rubber material from which the valve seal will be formed which comprises contacting the valve seal or rubber material with a solution of a physiologically acceptable surfactant for a sufficient period for the surfactant to impregnate the valve seal or rubber.

13. A method as claimed in claim 12 in which the solution is of a surfactant dissolved in Propellent 11.

14. A method as claimed in claim 12 in which the surfactant is a $C_{10}$–$C_{22}$ fatty acid, an anhydrosorbitol ester, or a phosphatidyl choline.

15. A method according to claim 12 wherein the surfactant is oleic acid or lecithin.

16. A method according to claim 12 wherein the surfactant is sorbitan trioleate.

17. A method as claimed in claim 16 in which sorbitan trioleate is present in a concentration of 2% by weight.

18. A method as claimed in claim 12 comprising the additional step of washing the valve seal or rubber material with a solvent prior to contacting with said solution.

* * * * *

UNITED STATES PATENT AND TRADEMARK OFFICE

CERTIFICATE OF CORRECTION

PATENT NO.: 5,427,282

DATED: June 27, 1995

INVENTOR(S): David J. Greenleaf et al.

It is certified that error appears in the above-identified patent and that said Letters Patent is hereby corrected as shown below:

Col. 7, line 34, claim 4, line 2, "is" should be --in--. (first occurrence)

Signed and Sealed this

Tenth Day of October, 1995

Bruce Lehman

*Attest:*

BRUCE LEHMAN

*Attesting Officer*

*Commissioner of Patents and Trademarks*